US011933173B2

(12) United States Patent
Marshall et al.

(10) Patent No.: US 11,933,173 B2
(45) Date of Patent: Mar. 19, 2024

(54) UTILITY PIPE INSTALLATION PROTECTION SYSTEM

(71) Applicant: The Charles Machine Works, Inc., Perry, OK (US)

(72) Inventors: Bradley S. Marshall, Perry, OK (US); Dustin L Blessum, Edmond, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 17/836,107

(22) Filed: Jun. 9, 2022

(65) Prior Publication Data

US 2022/0403703 A1 Dec. 22, 2022

Related U.S. Application Data

(60) Provisional application No. 63/209,007, filed on Jun. 10, 2021.

(51) Int. Cl.

| | |
|---|---|
| ***E21B 7/04*** | (2006.01) |
| ***E21B 19/24*** | (2006.01) |
| ***E21B 44/02*** | (2006.01) |
| ***E21B 45/00*** | (2006.01) |

(52) U.S. Cl.

CPC ..... *E21B 7/046* (2013.01); *E21B 44/02* (2013.01); *E21B 45/00* (2013.01); *E21B 19/24* (2013.01)

(58) Field of Classification Search

CPC ..... E21B 7/046; E21B 44/02; E21B 45/00; E21B 19/24

See application file for complete search history.

(56) References Cited

U.S. PATENT DOCUMENTS

| | | | | |
|---|---|---|---|---|
| 4,401,170 | A * | 8/1983 | Cherrington | E21B 17/00 175/73 |
| 6,682,264 | B1 * | 1/2004 | McGillis | E21B 7/28 405/184 |
| 9,274,013 | B2 | 3/2016 | Chau et al. | |
| 9,611,709 | B2 * | 4/2017 | O'Malley | E21B 23/10 |
| 9,835,025 | B2 * | 12/2017 | Reed | E21B 47/00 |
| 9,938,805 | B2 * | 4/2018 | Suprick | E21B 43/127 |
| 2016/0291201 | A1 * | 10/2016 | Tunc | E21B 17/006 |
| 2017/0167200 | A1 * | 6/2017 | Zheng | E21B 47/007 |
| 2017/0306743 | A1 * | 10/2017 | Difoggio | E21B 47/022 |
| 2018/0112802 | A1 | 4/2018 | Guerra | |
| 2021/0115742 | A1 * | 4/2021 | Agarwal | G01D 5/14 |

* cited by examiner

*Primary Examiner* — Jonathan Malikasim

(74) *Attorney, Agent, or Firm* — Tomlinson McKinstry, P.C.

(57) ABSTRACT

A system for monitoring installation of a utility product pipe within an underground borehole and detecting any issues with the installation process. The system utilizes one or more sensors to measure a parameter concerning the product pipe as the product pipe is pulled into the borehole, and one or more sensors to measure a parameter concerning the drill string as the drill string is pulled out of the borehole. The measured parameters are compared and analyzed to determine if any damage is likely to occur to the product pipe if the installation operation is not stopped and any issues remedied prior to continuing operation.

23 Claims, 7 Drawing Sheets

UTILITY PIPE INSTALLATION PROTECTION SYSTEM

RELATED APPLICATIONS

This application claims the benefit of provisional patent application Ser. No. 63/209,007, authored by Marshall et al., and filed on Jun. 10, 2021, the entire contents of which are incorporated herein by reference.

SUMMARY

The present disclosure is directed to a method of using a system. The system comprises an underground borehole having an entry point and an exit point, a horizontal directional drill situated at the entry point, and a product pipe situated at the exit point. The system further comprises a drill string positioned within the borehole and interconnecting the horizontal directional drill and the product pipe, a first sensor, and a second sensor.

The method comprises the steps of using the horizontal directional drill to pull the drill string out of the borehole while simultaneously pulling the product pipe into the borehole and using the first sensor to measure a previously determined parameter concerning the product pipe as the product pipe is pulled into the borehole. The method further comprises the steps of using the second sensor to measure a previously determined parameter concerning the drill string as the drill string is pulled out of the borehole, and comparing data collected by the first sensor to data collected by the second sensor to determine if the difference between the collected data is within an acceptable value range.

The present disclosure is also directed to a system comprising an underground borehole having an entry point and an exit point, a horizontal directional drill situated at the entry point and comprising a display, and a product pipe situated at the exit point. The system further comprises a drill string positioned within the borehole and interconnecting the horizontal directional drill and the product pipe, a first sensor configured to measure a rate of travel of the product pipe, a second sensor configured to measure a rate of travel of the drill string, and a processor supported on the horizontal directional drill and in communication with the display and the first and second sensors, the processor configured to display data collected by the first and second sensors on the display.

DETAILED DESCRIPTION

Figure 1:
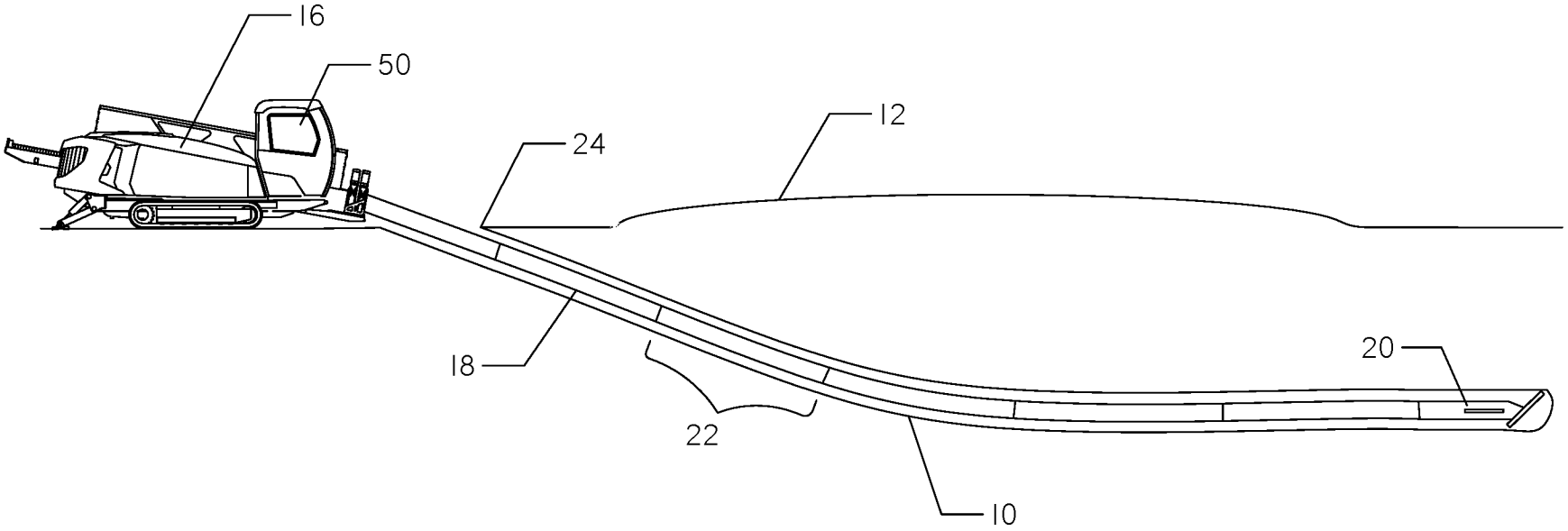
FIG. 1 is an illustration of a horizontal directional drilling operation.
Figure 2:
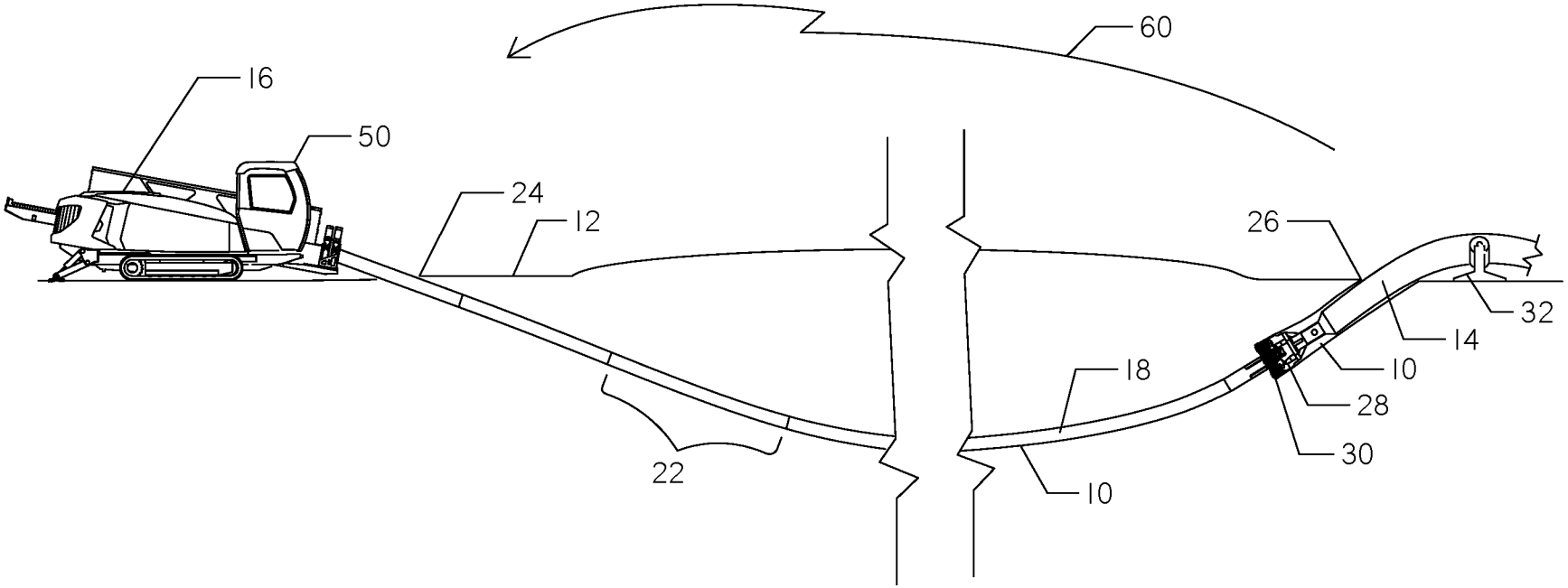
FIG. 2 is an illustration of a utility product pipe being installed within the borehole created during the horizontal directional drilling operation shown in FIG. 1.

Turning now to the figures, FIGS. 1 and 2 depict various stages of a horizontal directional drilling and utility pipe installation operation. The operation comprises forming a horizontal borehole 10 beneath a ground surface 12 and subsequently installing a utility product pipe 14 into the borehole 10, as shown in FIG. 2. The product pipe 14 may be a water, sewer, gas, or other utility conduit. A horizontal directional drill 16 creates the borehole 10 by rotating and advancing a drill string 18 supporting a drill bit 20 below the ground surface 12, as shown in FIG. 1. The drill string 18 is made of a plurality of pipe segments 22 joined together in an end-to-end arrangement. Each pipe segment 22 is generally an elongate tubular object.

The drill bit 20 initially breaks into the ground surface 12 at a borehole entry-point 24. As the drill bit 20 advances, the drill string 18 is lengthened by attaching new pipe segments 22 to the existing drill string 18. Such process is referred to as "making up" the drill string 18. Conversely, when the drill string 18 is removed from the borehole 10, pipe segments 22 are individually detached from the drill string 18. Such process is referred to as "breaking out" the drill string 18. During the making up process, the drill bit 20 is steered underground and eventually directed towards the ground surface 12, creating a borehole exit-point 26, as shown in FIG. 2.

Continuing with FIG. 2, the product pipe 14 is installed within the borehole 10 at the borehole exit-point 26. The product pipe 14 generally has a larger outer diameter than the drill string 18, requiring the borehole 10 to be enlarged prior to installation of the product pipe 14. The size of the borehole 10 is traditionally enlarged using a backreamer 28, as shown in FIG. 2. The backreamer 28 has a larger outer diameter than the drill bit 20 and comprises one or more cutting faces 30, as shown in FIG. 2.

At the borehole exit-point 26, the drill bit 20 is removed from the drill string 18 and the backreamer 28 is attached to the end of the drill string 18. In some embodiments, the drill bit 20 is not removed from the drill string 18 and the backreamer 28 is attached to the drill bit 20. Rotation of the drill string 18 rotates the backreamer 28, which cuts into the sides of the borehole 10. The drill 16 rotates and pulls the backreamer 28 through the borehole 10 as the drill 16 removes pipe segments 22 from the drill string 18.

Continuing with FIG. 2, the product pipe 14 is attached to the backreamer 28 opposite the drill string 18. The drill 16 pulls the product pipe 14 into the borehole 10 behind the backreamer 28 as the drill string 18 is being pulled out of the borehole 10. In many cases, the product pipe 14 comprises a long string of continuous pipe. The product pipe 14 is typically supported on a roller assembly 32 situated on the ground surface 12 adjacent the exit-point 26. The product pipe 14 glides across the roller assembly 32 as it is pulled into the borehole 10.

During operation, the product pipe 14 can become stuck on various items in the borehole 10 or around the exit-point 26. The opening of the borehole 10 at the exit-point 26 may also collapse and hold fast on a section of the product pipe 14. The drill 16 has sufficient power to keep pulling on the product pipe 14 even after the product pipe 14 becomes stuck. If the drill 16 continues to pull on a stuck product pipe 14, the product pipe 14 may stretch or even break in two. The present disclosure is directed to a system configured to monitor the product pipe 14 installation process and detect any issues that might lead to damage of the product pipe 14.

Figure 3:
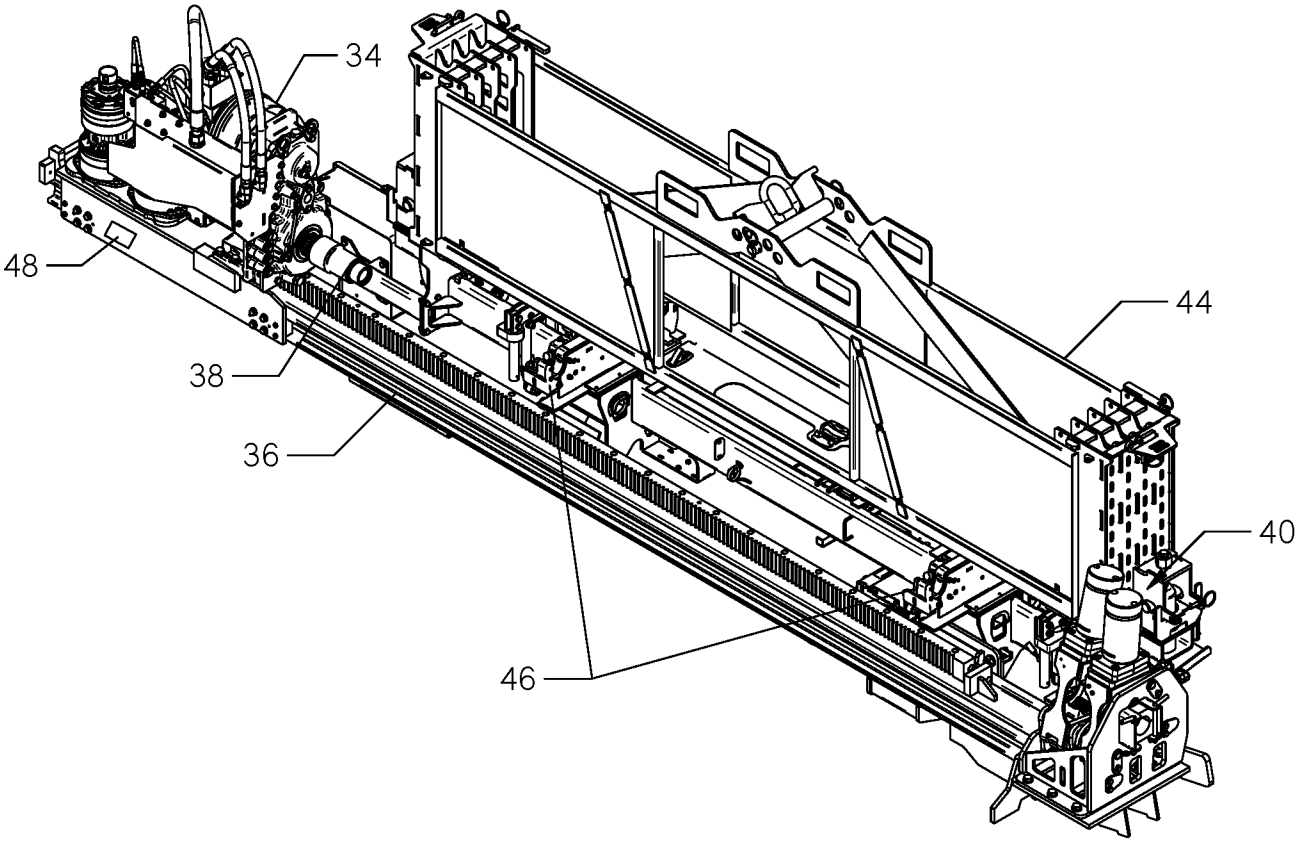
FIG. 3 is a perspective view of a drill frame, carriage, and pipe box that have been removed from the directional drill shown in FIGS. 1 and 2.
Figure 4:
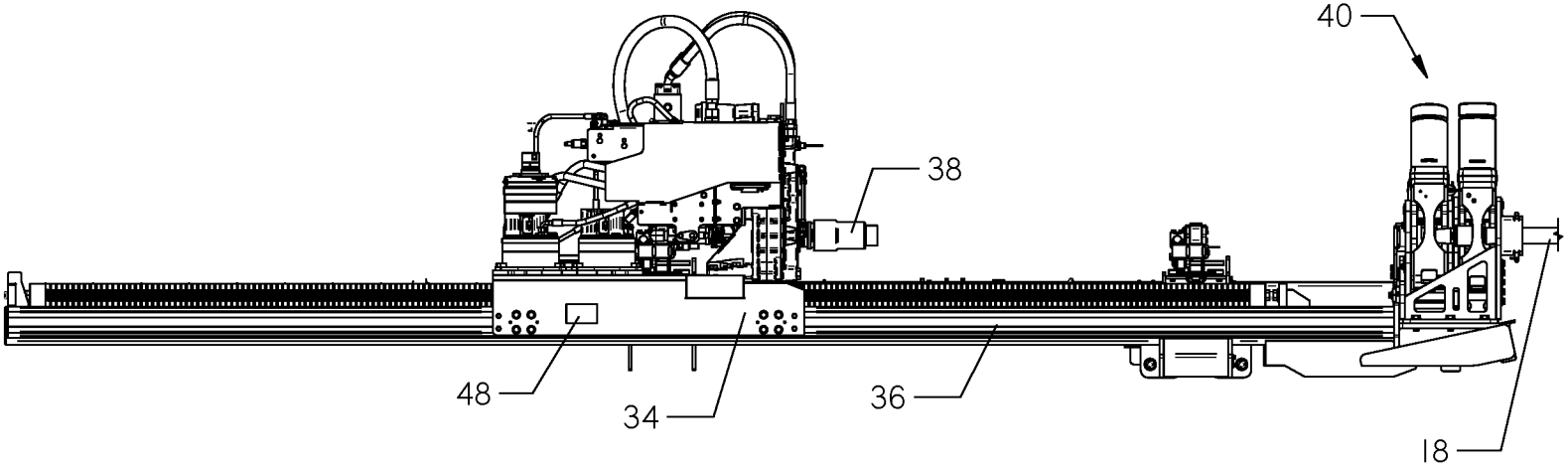
FIG. 4 is a side elevational view of the drill frame and carriage shown in FIG. 3. The carriage is shown at a midway point along the drill frame.
Figure 5:
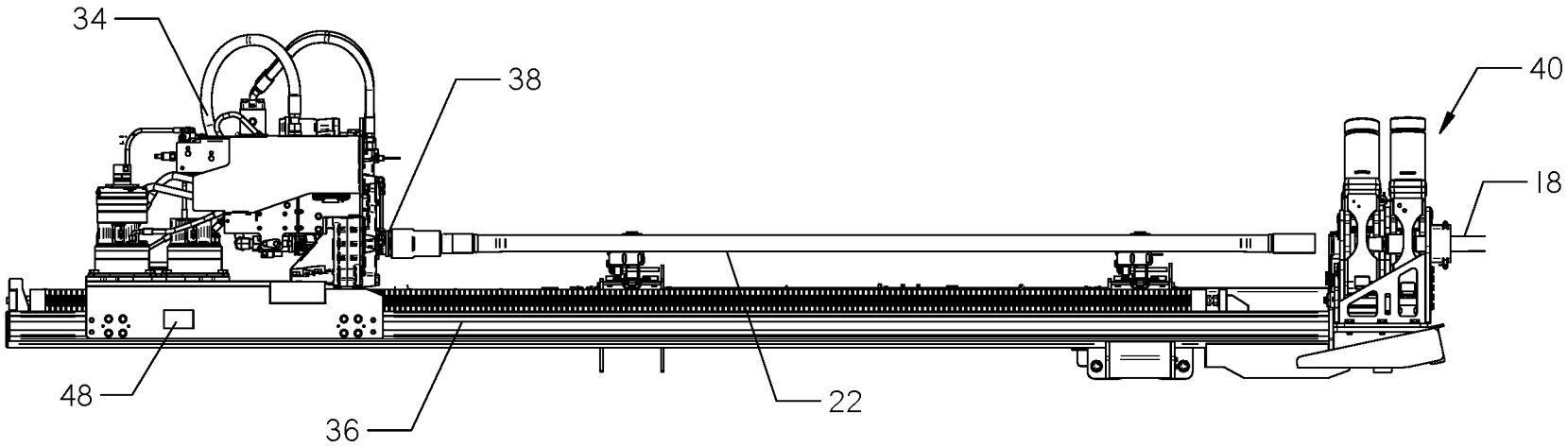
FIG. 5 is a side elevational view of the drill frame and carriage shown in FIG. 4, but a pipe segment is shown attached to the carriage.

Turning to FIGS. 3-5, the drill 16 comprises a carriage 34 supported on a drill frame 36. The pipe segments 22 are added or removed from the drill string 18 using the carriage 34. A rotating spindle 38 included in the carriage 34 threads pipe segments 22 onto or off the drill string 18. The carriage 34 moves axially along the drill frame 36 to push or pull the drill string 18 into and out of the borehole 10, as shown in FIGS. 4 and 5. A pair of wrenches 40 grip the drill string 18 at a front end of the drill frame 36. The pipe segments 22 are stored in a pipe box 44 supported on the drill frame 36, as shown in FIG. 3. A pair of shuttle arms 46 transfer pipe segments 22 between the carriage 34 and the pipe box 44.

Continuing with FIGS. 3-5, the drill 16 further comprises one or more sensors 48 supported on the carriage 34. The one or more sensors 48 are shown on the side of the carriage 34 in FIGS. 3-5; however, the sensors 48 may be supported at any desired position on the carriage 34. In alternative embodiments, the one or more sensors 48 may be supported on the drill frame 36 or another part of the drill 16.

The one or more sensors 48 are configured to measure a parameter concerning the drill string 18 as the drill string 18 is removed from the borehole 10. For example, the parameter may be the speed or rate of travel in inches per second at which the drill string 18 is pulled from the borehole 10, as shown in steps 100 and 104 in FIG. 7. Such rate may be measured by measuring the rate at which the carriage 36 moves relative to the drill frame 36 while gripping an end of the drill string 18. The one or more sensors 48 may comprise an encoder configured to measure the speed or rate of travel of the carriage 34. In alternative embodiments, other sensors known in the art configured to measure a rate of travel of an object may be used.

In further alternative embodiments, the parameter measured may be a total length of the drill string 18 that has been pulled from the borehole 10 at designated intervals during operation. The length may be measured in inches or feet, for example. In such embodiment, the one or more sensors 48 may comprise sensors configured to measure a length of an object.

The one or more sensors 48 are in communication with a processor having a display screen. The processor and display screen may be supported at the drill's operator station 50, as shown in FIGS. 1 and 2. Alternatively, the processor and display screen may be remote from the drill 16. For example, the display screen may be included in a handheld device. The communication between the one or more sensors 48 and the processor may be wired or wireless using a transmitter or transceiver. In operation, data collected by the one or more sensors 48 is displayed on the screen for an operator of the system to view. For example, the current rate in inches per second at which the drill string 18 is being pulled from the borehole 10 may be displayed on the screen. As another example, a total length of the drill string 18 in inches that has been pulled from the borehole 10 may be displayed on the screen. The rate or length may be continually updated on the screen in real-time.

Figure 6:
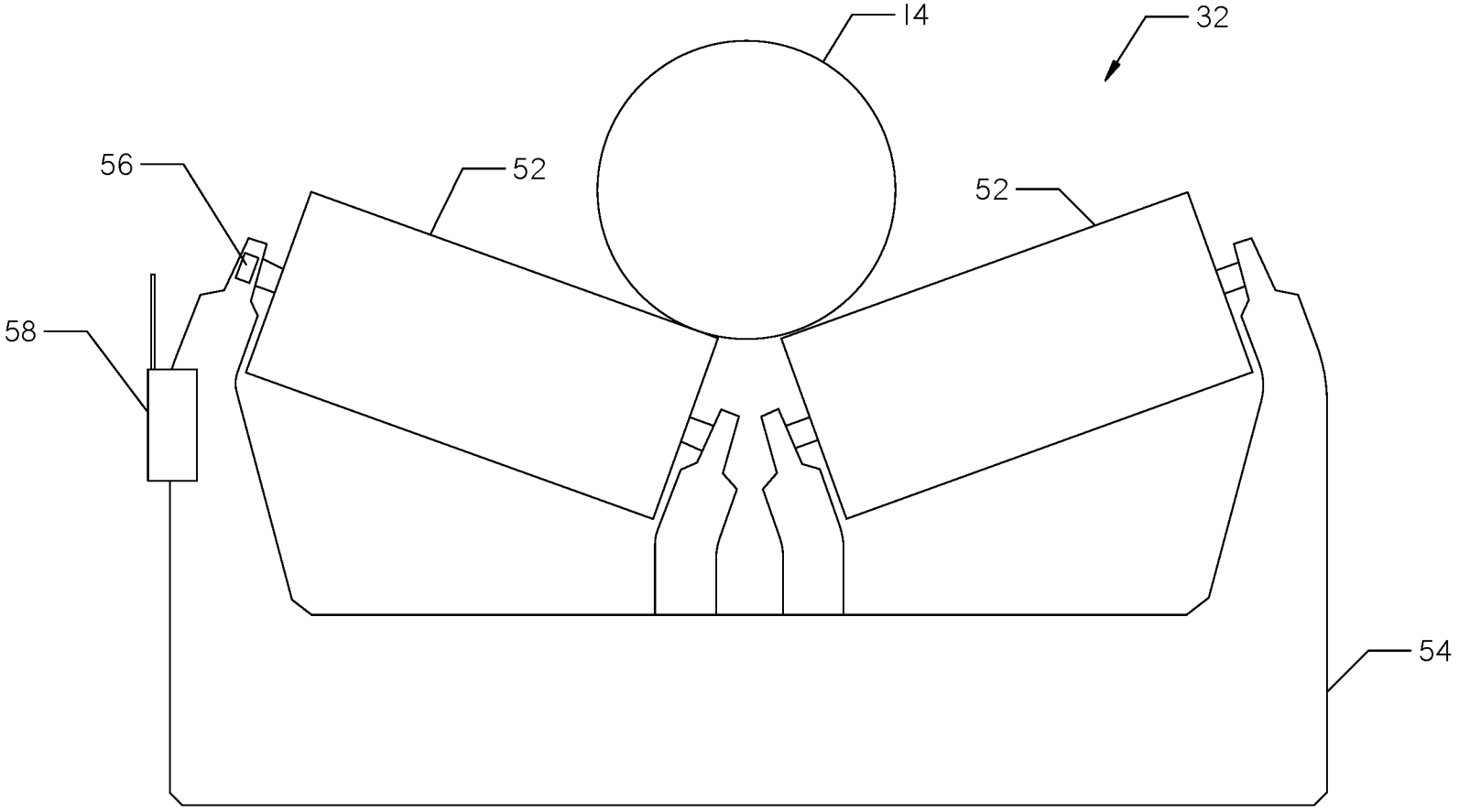
FIG. 6 is a side elevational view of the roller assembly shown in FIG. 2 supporting the product pipe.

Turning to FIG. 6, the roller assembly 32 comprises one or more rollers 52 supported on a roller stand 54. Two rollers 52 are shown in FIG. 6. The roller assembly 32 further comprises one or more sensors 56. The one or more sensors 56 are configured to measure a parameter concerning the product pipe 14 as the product pipe 14 is pulled into the borehole 10. For example, the parameter may be the rate of travel at which the product pipe 14 is pulled into the borehole 10, as shown in steps 102 and 106 in FIG. 7. Movement of the product pipe 14 over the rollers 52 causes the rollers 52 to rotate. The rate of travel of the product pipe 14 may be measured by measuring the rate at which the rollers 52 rotate as the product pipe 14 is pulled over the rollers 52. The one or more sensors 56 may comprise an encoder configured to measure the rate of rotation of the rollers 52. In alternative embodiments, other sensors known in the art configured to measure the rate of travel of an object may be used.

In further alternative embodiments, the parameter measured may be a total length of product pipe 14 that has been pulled into the borehole 10 at designated intervals during operation. The length may be measured in inches or feet, for example. In such embodiment, the one or more sensors 56 may comprise sensors configured to measure a length of an object.

The one or more sensors 56 are in communication with a transceiver 58. Such communication may be wired or wireless. The transceiver 58 may be supported on the roller assembly 32, as shown in FIG. 6. During operation, the transceiver 58 transmits the data collected by the one or more sensors 56 to the processor and display screen, as shown by arrow 60 in FIG. 2. Data collected by the one or more sensors 56 related to the product pipe 14 is displayed on the screen for an operator of the system to view. For example, the current rate in inches per second at which the product pipe 14 is pulled into the borehole 10 may be displayed on the screen. As another example, a total length of product pipe 14 in inches that has been pulled into the borehole 10 may be displayed on the screen. The rate or length may be continually updated on the screen in real-time.

If the rate of travel of the product pipe 14 is different from the rate of travel of the drill string 16, there may be an issue with the product pipe 14. For example, if the drill string 16 is pulled out of the borehole 10 faster than the product pipe 14 is pulled into the borehole 10, the product pipe 14 may stretch, which could lead to damage. Likewise, if the total length of drill string 18 that has been removed from the borehole 10 is different from the total length of product pipe 14 that has been pulled into the borehole 10, there may be an issue with the product pipe 14. For example, if the length of drill string 18 that has been pulled out of the borehole 10 is greater than the length of product pipe 14 that has been pulled into the borehole 10, the product pipe 14 may have stretched while underground. In operation, the lengths may be measured and compared at designated intervals. For example, the lengths may be measured and compared each time the carriage indicates that an entire pipe segment 22 or half of a pipe segment 22 has been removed from the borehole 10.

For each installation operation, there may be an acceptable value range at which the rates of travel or lengths between the drill string 18 and product pipe 14 may differ without causing damage to the product pipe 14. For example, different product pipes may be capable of stretching a certain amount without being damaged. During operation, there is traditionally a predictable amount of lag of movement of the product pipe 14 based on the product pipe's diameter, cross-section, the soil type, and the length to be installed. Such information can be used to calculate the product pipe's tension. If the product pipe's tension is known, the expected amount of stretch can be calculated. The acceptable amount of stretch can be used to determine the acceptable value range at which the rates of travel or lengths removed and installed may differ.

Figure 7:
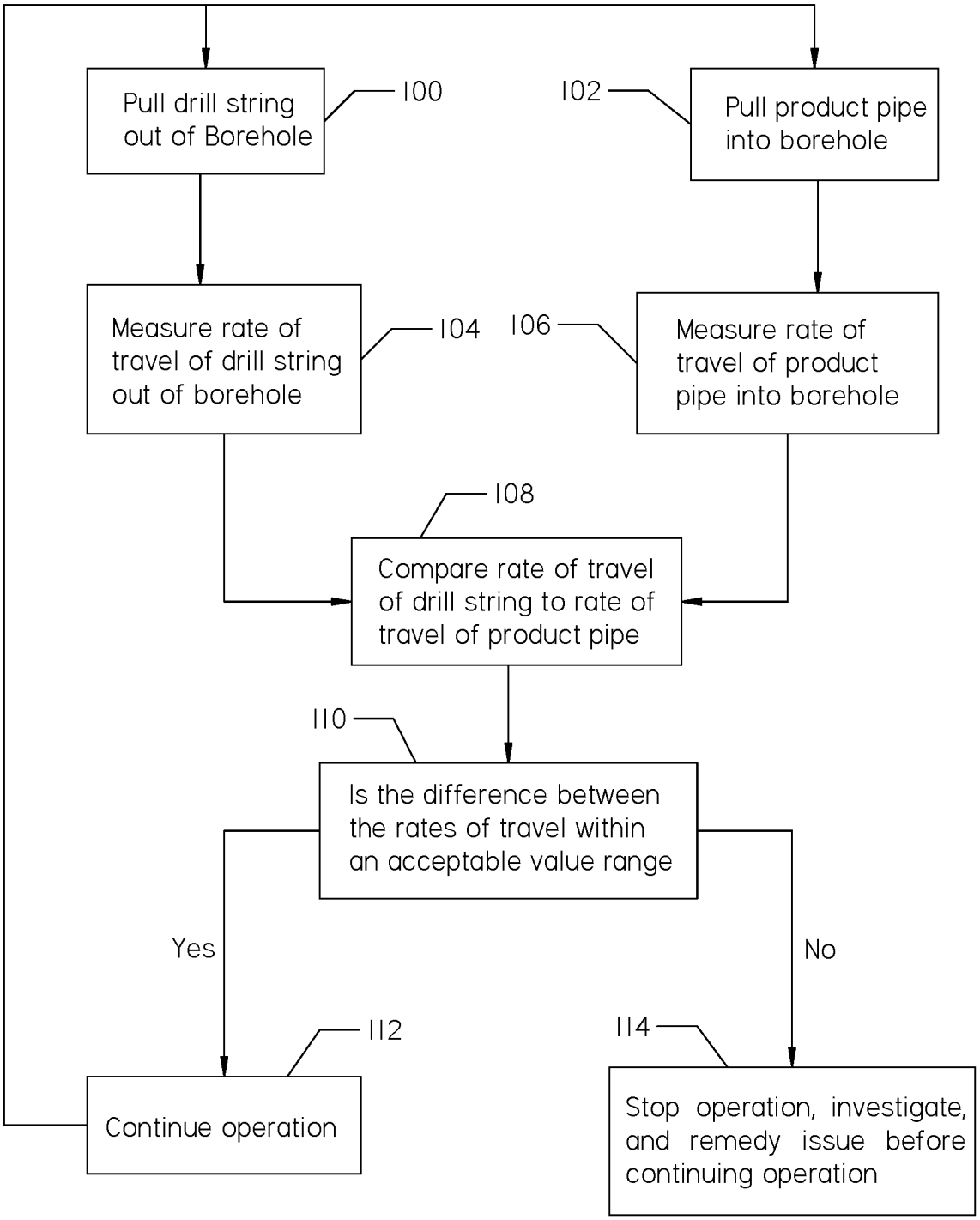
FIG. 7 is a flow chart depicting the method of using one embodiment of the system disclosed herein.

During operation, the operator may simply view the data related to the product pipe 14 and the drill string 16 and determine if the difference between the rates or lengths is within the acceptable value range, as shown in steps 108 and 110 in FIG. 7. If the difference is outside of the acceptable value range, the operator may stop operation of the drill 16 and investigate the cause, as shown in step 114 in FIG. 7. If the difference is within the acceptable value range, operation may continue and the rates of travel may continue to be measured and compared, as shown in step 112 in FIG. 7.

In addition to displaying the collected data on the screen, the processor may be configured to automatically calculate the difference between the rates of travel or lengths and determine if such difference is within the acceptable value range. If the difference between the rates of travel or lengths is outside of the acceptable value range, the processor may send a warning signal to the operator. The warning signal may be an audible sound or warning displayed on the screen. In addition, the warning signal may cause the drill 16 to automatically shut down operation.

In alternative embodiments, only the warning signal or difference between the rates of travel or lengths may be displayed on the screen for the operator without the collected data displayed. The processor may also be configured to calculate whether a potential breakage has occurred based on the difference between the rates of travel or lengths or calculate the amount of stretching of the product pipe 14 that has likely occurred or will occur if the drill 16 is not stopped.

In alternative embodiments, other parameters related to the drill string 18 and product pipe 14 and indicative of potential issues with the product pipe 14 may be measured and compared. Preferably, the parameters for the drill string 18 are the same as the parameters for the product pipe 14 and are measured using the same units for ease of comparison. However, in alternative embodiments, the processor may be configured to analyze different parameters and units for each the drill string 18 and the product pipe 14 and make any needed conversions or calculations to determine if there is a potential issue with the product pipe 14.

In further alternative embodiments, more than one parameter may be measured and compared. For example, both the rates of travel and the lengths removed and installed may be measured, compared, and displayed for an operator. The system may be configured to shut down operation of the drill 16 if one or both parameters compared are outside of the acceptable value range.

In even further alternative embodiments, the one or more sensors 48 or 56 may be supported off-board of the drill 16 and/or the roller assembly 32. For example, the one or more sensors 48 or 56 may be included in a handheld device positioned adjacent the drill 16 and/or the roller assembly 32. The transceiver 58 may likewise be positioned off-board the roller assembly 32.

The system disclosed herein may also be used when pulling a product pipe into a borehole using a pipe extractor, like that described in U.S. Patent Publication No. 2019/0049040, authored by Wentworth et al., the entire contents of which are incorporated by reference. Another example of a pipe extractor is described in U.S. Pat. No. 7,128,499, issued to Wentworth, the entire contents of which are incorporated herein by reference. In such case, one or more sensors may be configured to monitor a parameter concerning the pipe to be replaced being pulled from the borehole by the pipe extractor. Additionally, one or more sensors may be configured to measure a parameter concerning the product pipe being pulled into the borehole behind the pipe to be replaced. Like the embodiment described above, the sensors would communicate with a processor and display screen visible to an operator and help the operator determine if the operation needs to be stopped and any issues remedied before continuing.

The various features and alternative details of construction of the apparatuses described herein for the practice of the present technology will readily occur to the skilled artisan in view of the foregoing discussion, and it is to be understood that even though numerous characteristics and advantages of various embodiments of the present technology have been set forth in the foregoing description, together with details of the structure and function of various embodiments of the technology, this detailed description is illustrative only, and changes may be made in detail, especially in matters of structure and arrangements of parts within the principles of the present technology to the full extent indicated by the broad general meaning of the terms in which the appended claims are expressed.

The invention claimed is:

1. A method of using a system, the system comprising:
an underground borehole having an entry point and an exit point;
a horizontal directional drill situated at the entry point;
a product pipe situated at the exit point;
a drill string positioned within the borehole and interconnecting the horizontal directional drill and the product pipe;
a first sensor; and
a second sensor;
the method comprising:
using the horizontal directional drill to pull the drill string out of the borehole while simultaneously pulling the product pipe into the borehole;
using the first sensor to measure a previously determined parameter concerning the product pipe as the product pipe is pulled into the borehole;
using the second sensor to measure a previously determined parameter concerning the drill string as the drill string is pulled out of the borehole; and
comparing data collected by the first sensor to data collected by the second sensor to determine if the difference between the collected data is within an acceptable value range.

2. The method of claim 1, further comprising:
prior to the comparing step, displaying the data collected by the first and second sensors on a display visible to an operator of the system.

3. The method of claim 1, further comprising:
prior to the comparing step, transmitting the data collected by the first and second sensors to a processor;
in which the comparing step is performed by the processor.

4. The method of claim 3, further comprising:
displaying the collected data on a display visible to an operator of the system.

5. The method of claim 3, further comprising:
sending a warning signal to an operator of the system if the processor determines that the difference between the collected data is outside of the acceptable value range.

6. The method of claim 1, further comprising:
stopping movement of the drill string if the difference between the collected data is outside of the acceptable value range.

7. The method of claim 1, in which the system further comprises:

one or more rollers situated at the exit point; in which the product pipe is supported on the one or more rollers.

8. The method of claim 7, in which the first sensor is supported on the one or more rollers.

9. The method of claim 8, in which the first sensor is an encoder.

10. The method of claim 8, in which the system further comprises:

a transmitter supported on the one or more rollers and in communication with the first sensor and configured to transmit data from the first sensor to a display visible to an operator of the system.

11. The method of claim 1, in which the previously determined parameter concerning the product pipe is a rate of travel of the product pipe as it is pulled into the borehole.

12. The method of claim 11, in which the previously determined parameter concerning the drill string is a rate of travel of the drill string as it is pulled out of the borehole.

13. The method of claim 12, in which the acceptable value range comprises an acceptable value difference between the rate of travel of the product pipe and the rate of travel of the drill string.

14. The method of claim 1, in which the previously determined parameter concerning the product pipe is a total length of the product pipe that has been pulled into the borehole.

15. The method of claim 14, in which the previously determined parameter concerning the drill string is a total length of the drill string that has been pulled out of the borehole.

16. The method of claim 15, in which the acceptable value range comprises an acceptable value difference between the total length of the product pipe that has been pulled into the borehole and the total length of the drill string that has been pulled out of the borehole.

17. The method of claim 1 in which the first sensor is proximate the exit point of the underground borehole and the second sensor is proximate the entry point of the underground borehole.

18. The method of claim 1 in which the first sensor is not pulled towards the borehole during the step of using the horizontal directional drill to pull the drill string out of the borehole while simultaneously pulling the product pipe into the borehole.

19. A method of using a system, the system comprising:

an underground borehole having an entry point and an exit point;

a horizontal directional drill situated at the entry point;

a product pipe situated at the exit point;

a drill string positioned within the borehole and interconnecting the horizontal directional drill and the product pipe;

a first sensor;

a second sensor; and a carriage supported on a drill frame and movable between first and second ends of the frame, the carriage in gripping engagement with an end of the drill string; in which the second sensor is supported on the carriage and measures a rate of travel of the carriage while gripping the end of the drill string;

the method comprising:

using the horizontal directional drill to pull the drill string out of the borehole while simultaneously pulling the product pipe into the borehole;

using the first sensor to measure a previously determined parameter concerning the product pipe as the product pipe is pulled into the borehole;

using the second sensor to measure a previously determined parameter concerning the drill string as the drill string is pulled out of the borehole; and comparing data collected by the first sensor to data collected by the second sensor to determine if the difference between the collected data is within an acceptable value range.

20. A system, comprising:

an underground borehole having an entry point and an exit point;

a horizontal directional drill situated at the entry point and comprising a display;

a product pipe situated at the exit point;

a drill string positioned within the borehole and interconnecting the horizontal directional drill and the product pipe;

a first sensor situated proximate the exit point and configured to measure a rate of travel of the product pipe;

a second sensor situated proximate the entry point and configured to measure a rate of travel of the drill string;

a processor supported on the horizontal directional drill and in communication with the display and the first and second sensors, the processor configured to display data collected by the first and second sensors on the display.

21. The system of claim 20, in which the processor is further configured to compare the data collected by the first and second sensors and to determine if the rate of travel of the product pipe is different from the rate of travel of the drill string.

22. The system of claim 21, in which the processor is further configured to display a warning signal on the display if the difference between the rate of travel of the product pipe and the rate of travel of the drill string is outside of an acceptable value range.

23. The system of claim 20, further comprising:

one or more rollers situated at the exit point and supporting the product pipe; in which the first sensor is supported on the one or more rollers.

* * * * *